US006986681B2

(12) United States Patent
Tsai

(10) Patent No.: US 6,986,681 B2
(45) Date of Patent: Jan. 17, 2006

(54) HDMI CONNECTOR

(75) Inventor: Wen-Hsien Tsai, Taipei Hsien (TW)

(73) Assignee: Advanced Connectek, Inc., Taipei (TW)

( * ) Notice: Subject to any disclaimer, the term of this patent is extended or adjusted under 35 U.S.C. 154(b) by 0 days.

(21) Appl. No.: 10/781,667

(22) Filed: Feb. 20, 2004

(65) Prior Publication Data

US 2005/0186843 A1 Aug. 25, 2005

(51) Int. Cl.
*H01R 13/648* (2006.01)

(52) U.S. Cl. ..... 439/607; 439/609; 439/939

(58) Field of Classification Search ..... 439/607, 439/609, 660, 939, 541.5
See application file for complete search history.

(56) References Cited

U.S. PATENT DOCUMENTS 5,178,562 A * 1/1993 Ermini ..... 439/609
5,865,646 A * 2/1999 Ortega et al. ..... 439/607
6,113,428 A * 9/2000 Yeh ..... 439/609
6,132,253 A * 10/2000 Wu ..... 439/607
6,139,367 A * 10/2000 Yeh ..... 439/609
6,227,880 B1 * 5/2001 Zhu et al. ..... 439/92
6,238,241 B1 * 5/2001 Zhu et al. ..... 439/541.5
6,364,706 B1 * 4/2002 Ando et al. ..... 439/607
6,364,707 B1 * 4/2002 Wang ..... 439/607
6,379,185 B2 * 4/2002 Belopolsky et al. ..... 439/607
6,533,612 B1 * 3/2003 Lee et al. ..... 439/607
6,579,121 B2 * 6/2003 Belopolsky ..... 439/541.5
6,645,013 B1 * 11/2003 Toyota et al. ..... 439/660
6,682,368 B2 * 1/2004 Murr et al. ..... 439/607
6,688,915 B2 * 2/2004 Moriwake et al. ..... 439/607
6,709,286 B1 * 3/2004 Korsunsky et al. ..... 439/557
6,786,772 B1 * 9/2004 Liu ..... 439/620

* cited by examiner

*Primary Examiner*—Gary Paumen
(74) *Attorney, Agent, or Firm*—Johnson, Lin & Associates; Chauncey B. Johnson, Esq.

(57) ABSTRACT

The present invention relates to a HDMI connector comprising of an insulated housing, a metallic housing and a contact terminal unit. The insulated housing is standardized but the metallic housing and the contact terminal unit are modified and combined with the insulated housing to form the HDMI connector of the present invention. The metallic housing is modified to have a flange or no flange and to have vertical insertion type pins or horizontal SMT type pins, and the terminal contact unit attached thereto. The terminal unit is modified to have spikes whose rear ends are either bent and flattened to form horizontal SMT type terminal solder pins or to have spikes whose rear ends are not bent and not flattened to form vertical insertion type pins.

19 Claims, 8 Drawing Sheets

HDMI CONNECTOR

BACKGROUND OF THE INVENTION

1. Field of the Invention

The present invention relates to a HIGH DEFINITION MULTIMEDIA INTERFRACE (HDMI) connector. Specifically, the present invention relates to a small HDMI connector used in digital televisions, DVD players, deck-top boxes or video signal converters and other digital Audio/Video (AV) products.

2. Description of the Related Prior Art

Nowadays, Liquid Crystal Displays (LCDs) have become the output device of choice for use in AV products. The increasing role of LCDs in AV products such as PC monitors and TV displays, etc. has created a need for connectors capable of transmitting digital signals between the former and the latter. The enhanced HDMI device of the present invention is a connector capable of transmitting digital signals between AV products, such as PC monitors and TV displays, and LCDs.

A HDMI device is a transmission interface utilized for transmitting high definition multimedia digital signals, including high fidelity images and multi-channel audio signals. The earlier HMDIs were disclosed by AV manufacturers, such as HITACHI, Panasonic, Philips, Sony, Silicon Image, Thomson and Toshiba. These manufacturers established the use of HDMIs based on the standard specification of Digital Visual Interface (DVI) technology, which protects against signal detection and privacy by encoding signals at the transmitting end and decoding signals at the receiving end. Although the DVI technology improved the resolution and quality of pictures on LCD screens and protected against detection and piracy, however, it lacked the ability to transmit digital audio signal and thus required users to incorporate an additional line or use traditional AV terminal for signal transmission. Having an additional line to compensate for lack of signal transmission capabilities is not only of compatibility concerns when used with personal computers but is chaotic when used with family theater electronics, whose usage have greatly increased among consumers. Additional lines connected to family theater electronics substantially increase the number of installation components and further increase the prices of these products. Furthermore, using DVI technology with smaller electronic devices such as digital video cameras would be cumbersome.

The HDMI connector of this invention is not only in compliance with the standard specification of the aforementioned generic DVI technology, but its design is capable of both transmitting digital signal transmission and transmitting uncompressed signal data. Furthermore, the present HDMI design enhances compatibility with various video specification formats, and when used with various AV consumer products provides video signals of both high quality and high fidelity. In addition, this device is smaller as compared with prior art connectors, this device uses less cable or connection for transmitting uncompressed data and this device is capable of protecting against signal detection and piracy by encoding signals at the transmitting end and decoding signals at the receiving end. Furthermore, this device provides two-way communication for digital appliances, such as TV, DVD player, deck top box (signal converter) and small connectors of other digital AV products and this device can be conveniently installed inside different AV products, thus reducing the interface connector volume significantly.

Based on the aforementioned paragraphs above, the HDMI connector of the present invention will no doubt become a mainstream connector of the AV industry. We expect this connector to become the first connector based on AV standard specification technology, which will be supported by both software suppliers and system providers of consumer electronics.

HDMI connectors are usually mounted on the edge of printed circuit boards to accommodate the housing structure of the host product and to provide interface function for connecting external and internal circuits of the host product. Unlike the present invention, components of prior art HDMIs such as metallic housings and terminal units are not interchangeable. That is, because a metallic housing of a HDMI connector could comprise of a vertical insertion type housing or a surface mount technology horizontal type (SMT) housing and a terminal unit of a HDMI connector could comprise of a vertical insertion type unit or a SMT type unit, using existing HDMI connectors create a procurement nightmare due to lack of interchangeability. The present invention discloses HDMIs with interchangeable metallic housings and terminal units, which reduces confusion in accessories procurement due to lack of interchangeability and reduces cost associated with purchasing and stockpiling related accessories due to lack of interchangeability.

SUMMARY OF THE INVENTION

An object of this invention is to disclose HDMI connectors capable of using modified metallic housing components, modified terminal unit components and a single, uniform insulated housing component.

Another object of this invention is to disclose modified HDMI connectors yets capable of complying with standardized HDMI specifications.

Yet, another object of this invention is to disclose HDMI connectors which use a uniform insulated housing design combined with variable metallic housing design and with variable contact terminal design for assembling distinct embodiments of the present invention.

Still, another object of this invention is to disclose HDMI connectors with modified solder pins and modified flanges, wherein the solder pins are comprised of vertical insertion types and horizontal insertion types.

Yet still, another object of this invention is to disclose HDMI connectors with or without flanges optionally based on the requirements of the product being assembled.

Still further, another object of this invention is to disclose HDMI connectors with terminal unit comprised of vertical insertion types and horizontal insertion types.

In order to provide an understanding of the principles associated with the present invention, reference will now be made to the embodiments illustrated in the drawings and specific language will be use to describe the same. However, no limitation of the scope of the invention is herby intended. Thus, any alteration and modifications of the inventive features illustrated herein and any additional application of the principle of the present invention as illustrated herein which would normally occur to one skill in the relevant art and having possession of this disclosure are to be considered within the scope of the present invention described herein.

DETAILED DESCRIPTION OF THE INVENTION

The HDMI connector of the present invention is comprised of an insulated housing, a metallic housing and a contact terminal unit. The insulated housing is standardized or un modified, but the metallic housing and the contact terminal unit are modified and combined with the insulated housing to form the HDMI connector of the present invention. The structure of the metallic housing is primarily modified in the following ways: either having a metallic housing with or without a flange; and having a metallic housing with a vertical insertion solder type pin or with a horizontal (SMT) type solder pin. In a similar fashion, the structure of the contact terminal unit is primarily modified in the following ways: either a contact terminal unit wherein a first type is comprised of spikes whose rear ends are bent and flattened to form horizontal SMT type terminal solder pins; or a second type comprised of spikes whose rear ends are not bent and not flattened to form vertical insertion type pins.

Figure 5:
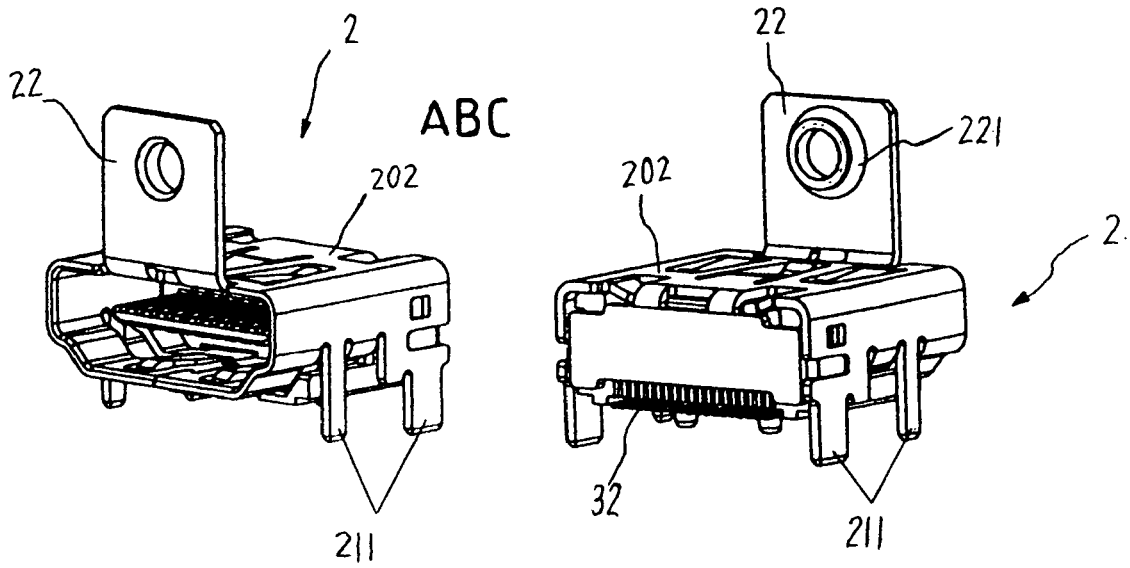
FIG. 5 is a perspective view of the first embodiment of the present invention illustrating a combination module designated as "ABC" type connector.
Figure 6:
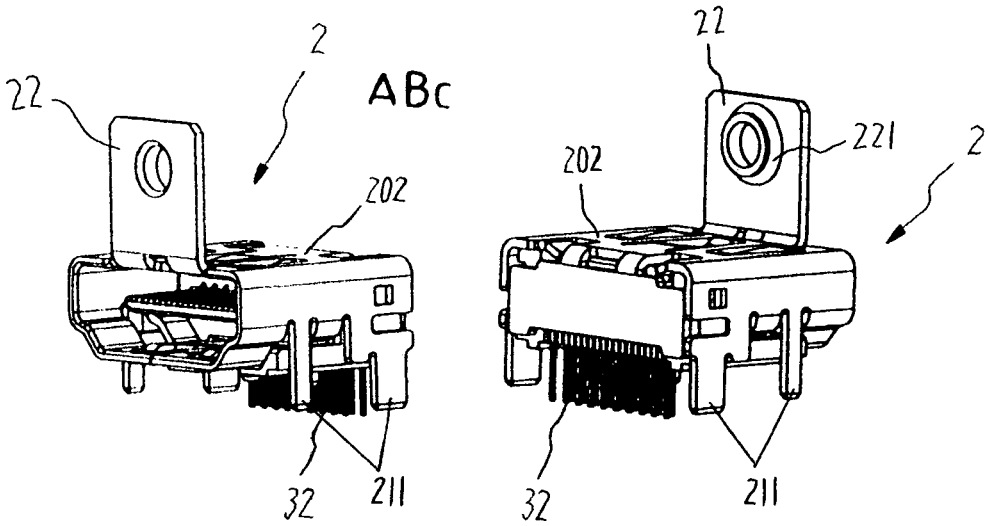
FIG. 6 is a perspective view of the second embodiment of the present invention illustrating a combination module designated as "ABc" type connector.
Figure 7:
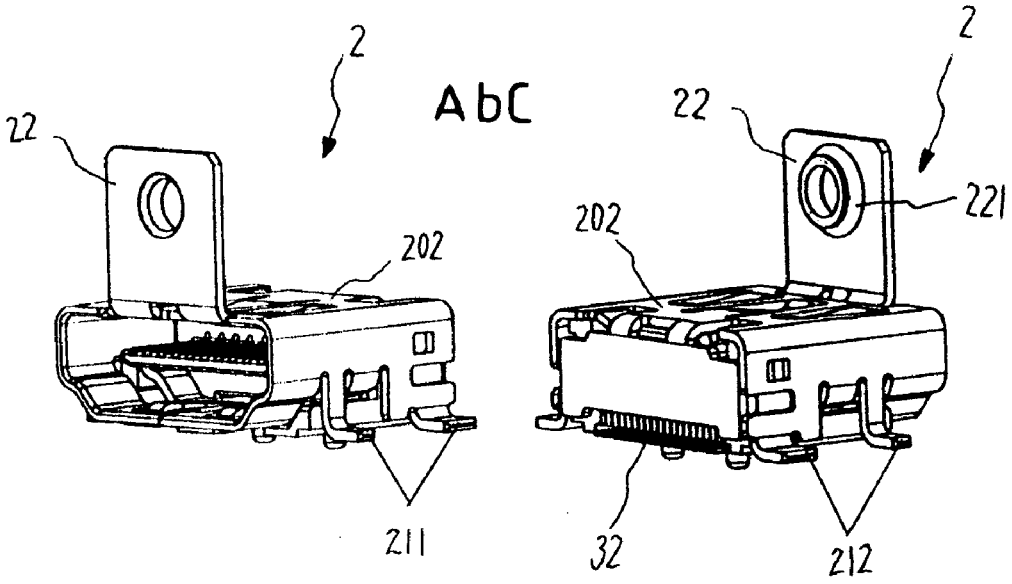
FIG. 7 is a perspective view of the third embodiment of the present invention illustrating a combination module designated as "AbC" type connector.
Figure 8:
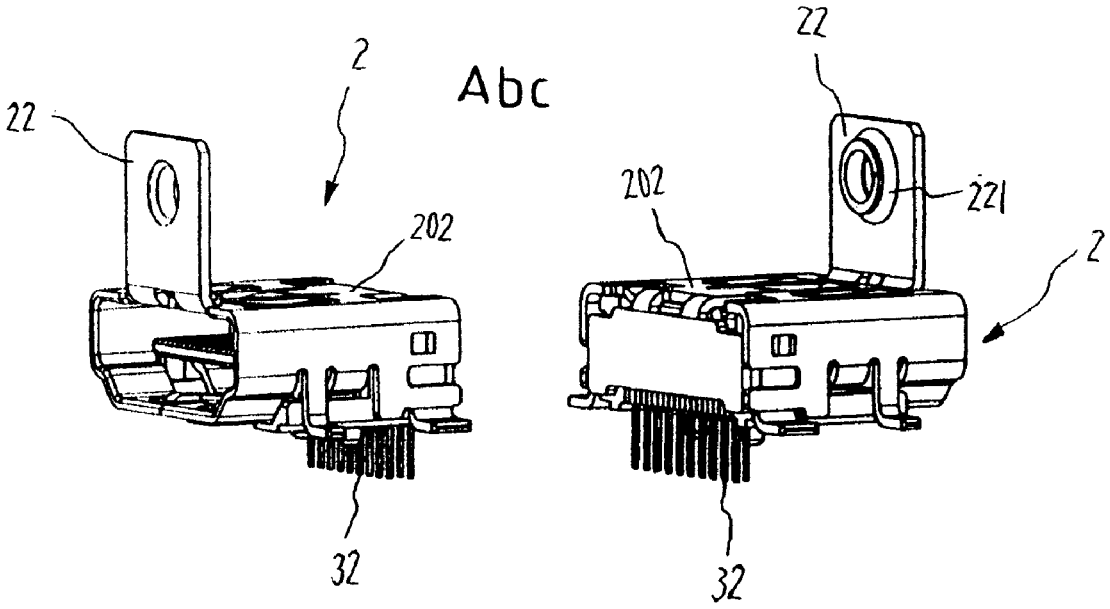
FIG. 8 is a perspective view of the fourth embodiment of the present invention illustrating a combination module designated as "Abc" type connector.
Figure 9:
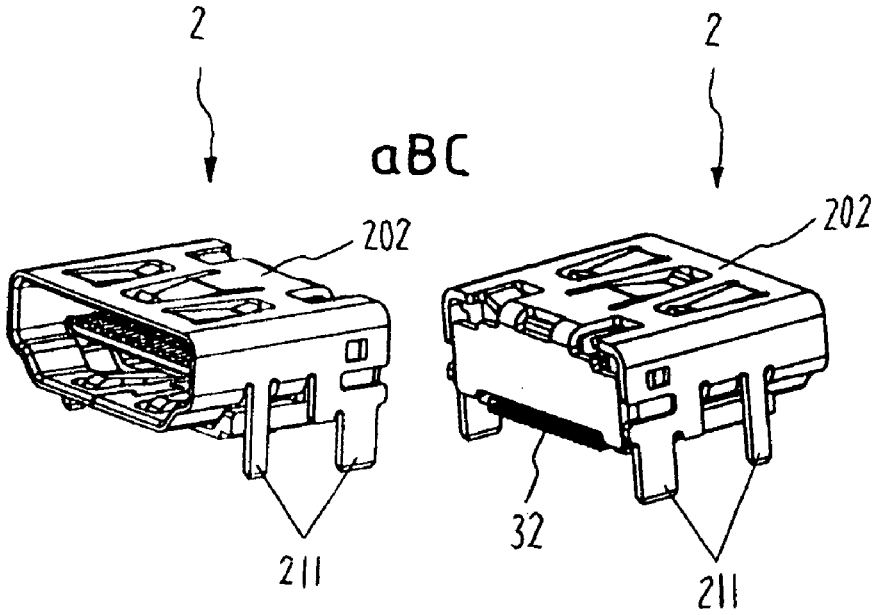
FIG. 9 is a perspective view of the fifth embodiment of the present invention illustrating a combination module designated as "aBC" type connector.
Figure 10:
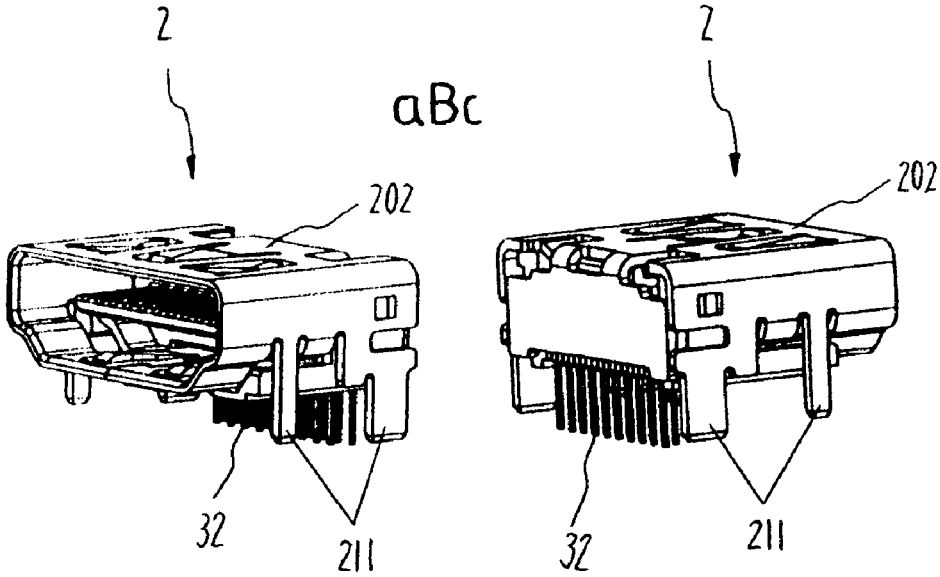
FIG. 10 is a perspective view of the sixth embodiment of the present invention illustrating a combination module designated as "aBc" type connector.
Figure 11:
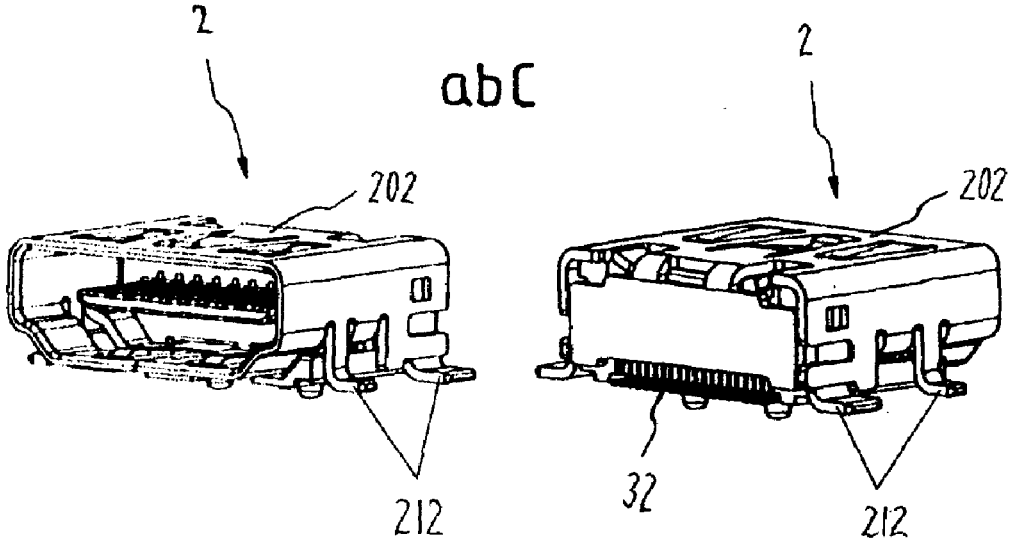
FIG. 11 is a perspective view of the seventh embodiment of the present invention illustrating a combination module designated as "abC" type connector.

The interior design of the metallic housing is adapted to engage and interlock with the insulated housing when a combination module is formed. Because the present invention possesses many different combination modules, the inventor has used the following notations to designate each embodiment: FIG. 5 as the "ABC" type HDMI connector; FIG. 6 as the "ABc" type HDMI connector; FIG. 7 as the "AbC" type HDMI connector; FIG. 8 as the "Abc" type HDMI connector; FIG. 9 as the "aBC" type HDMI connector; FIG. 10 as the "aBc" type HDMI connector; FIG. 11 as the "abC" type HDMI connector; and FIG. 12 as the "abc" type HDMI connector. These designations are influenced by the modifications made to a metallic housing and a contact terminal unit, which are combined with an insulated housing to form a particular HDMI combination module.

Figure 1:
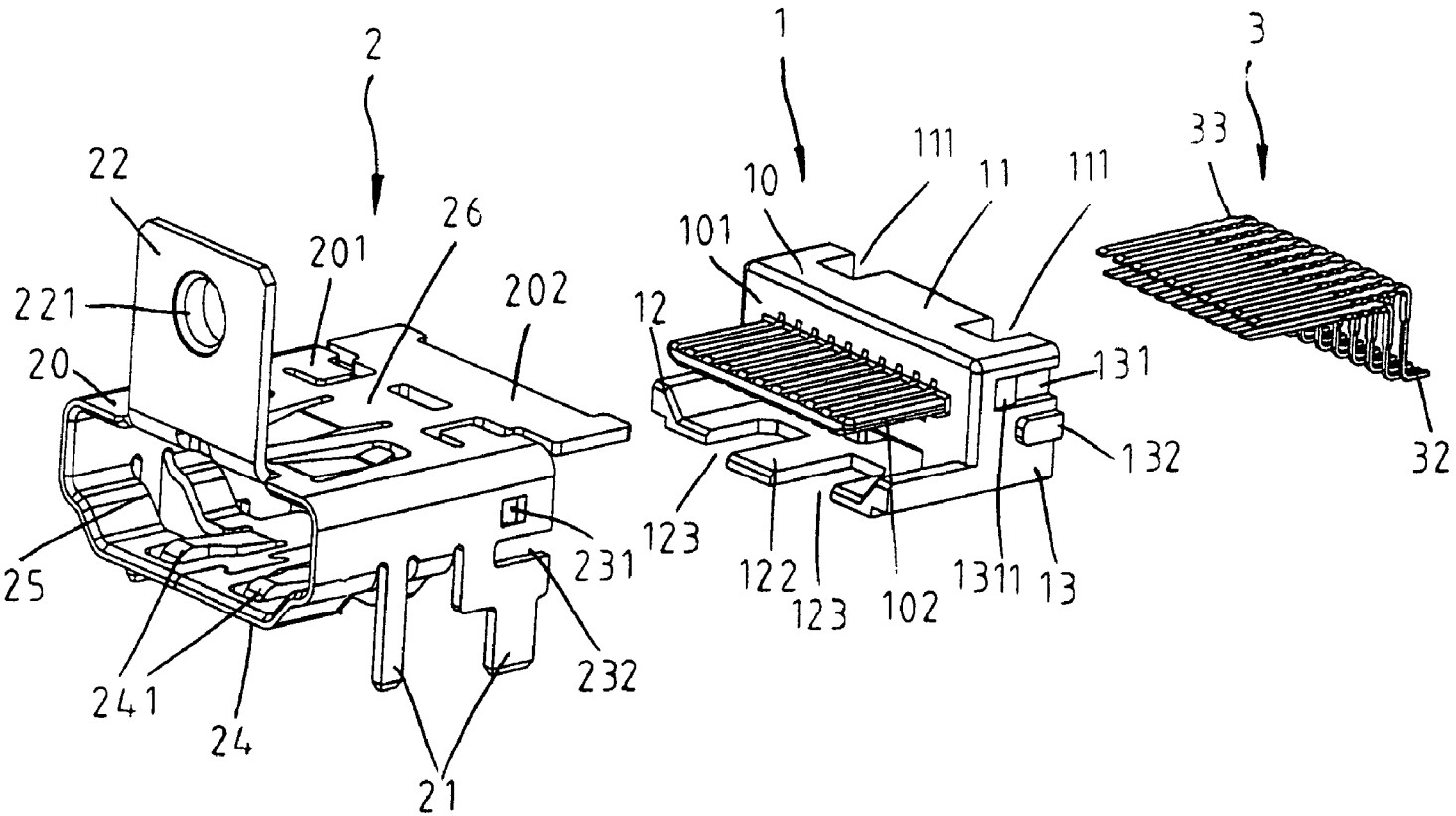
FIG. 1 is a perspective view of the HDMI connector components illustrating the metallic housing, the insulated housing and the terminal contact unit of the present invention.
Figure 2:
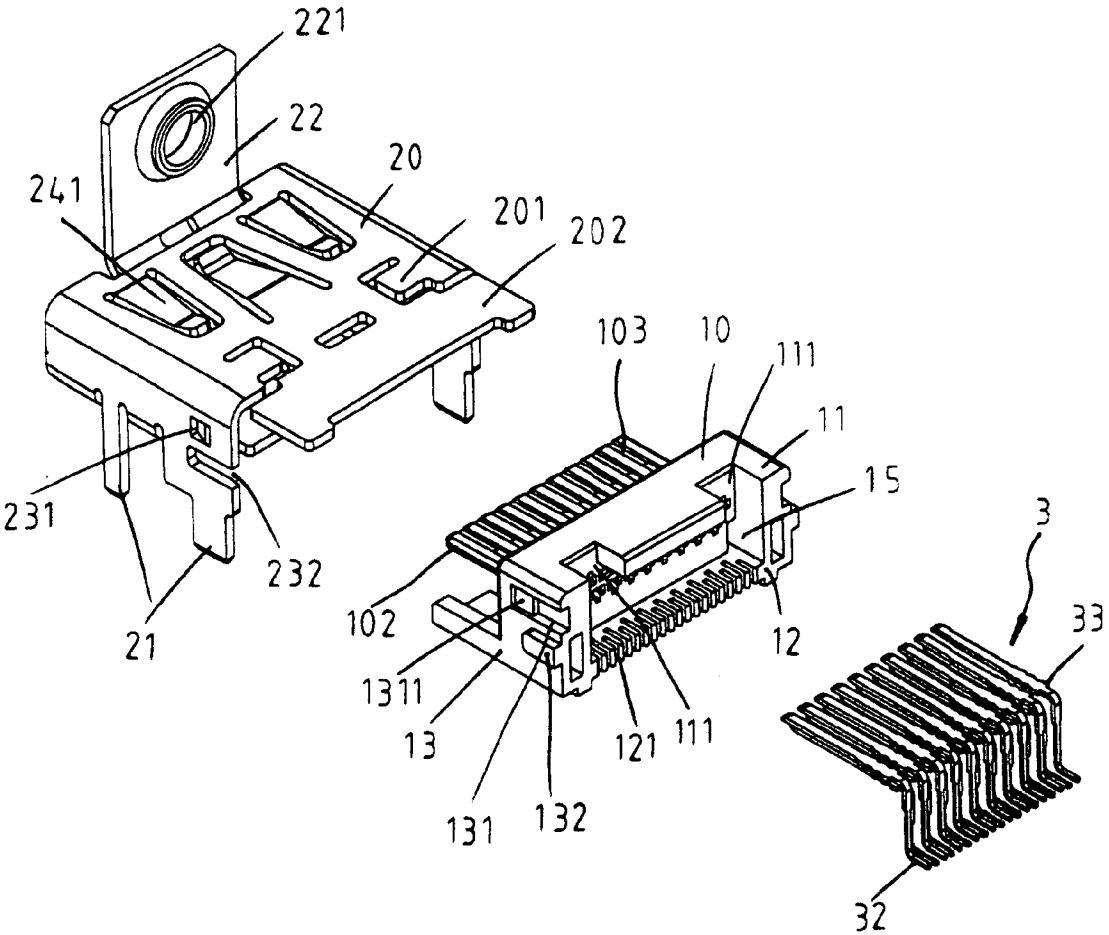
FIG. 2 is another perspective view of the HDMI connector components illustrating the metallic housing, the insulated housing and the terminal contact unit of the present invention.

Referring to FIG. 1 and FIG. 2, wherein an "ABC" type connector will be described herein, the insulated housing 1 has a rectangular main body 10 with a flat terminal block 102 projected from the front surface 101 of the main body 10. On the terminal block, there is a plurality of guided slots 103 on both the front and the reverse surfaces of the terminal block wherein portions of the terminal contact unit 3 is fitted when assembled. The guided slots extend from the front of the main body 10 to the hollow portion 15 at the rear end of the main body.

Thus when the insulated housing 1 is inserted into the metallic housing 2, the front surface 101 of the insulating housing 1 is thrust against the rear end insertion slots at the bottom of the metallic housing 2, which maintains the metallic housing in place. Also, dented slots 111 located on the rear end of the insulting housing's top surface 11 are designed to latch and fix the former with the resilient fold portions 201 located on the top surface 26 of the metallic housing 2. In a similar fashion, slots 131 and projections 132 are furnished on both side surfaces 13 of the main body 10 of the insulating housing 1 and each slot 131 is designed to fit within a corresponding inward projection stop wedge 231 located on the metallic housing 2. Simultaneously, each stop block 1311 adjacent each slot 131 on both side surfaces 13 of the main body 10 is designed to thrust against their respective stop wedge 231, and the projections 132 are mated with the slide slots 232 of the metallic housing 2 to secure the insulated housing therein without further backward and forward displacement respectively.

In addition, the positioning paths 121 at the rear portions of the bottom surface 12 of the insulating housing provide equal number of guide slots for inserting the terminals of the terminal contact unit 3 to secure the solder pins at points of insertion, and the bottom plate 122 extending from the front end of the bottom surface 12 of the main body 10 having inclined end section on both sidewalls form a carrier, which integrates with the bottom surface 24 of the metallic housing 2 thereby firmly fixing the insulating housing within the metallic housing. Also, recesses 123 furnished on the bottom plate 122 are positioned and aligned with clamps 241 and yet the recesses remain available after integration of the insulated housing with the metallic housing, and positioning posts are provided at the bottom of said insulated housing to secure and to position the connector firmly on a printed circuit board.

The interior structure design of the metallic housing corresponds to the insulated housing. A critical feature of this invention is the integration of the insulated housing and rear portion of the metallic housing. This integrated and interlocking structure consist of a fold structure piece 201 on the top surface 26 of the metallic housing, a fold plate 202 extended towards the rear end of the metallic housing, inward projected stop wedges 231 on opposite sides of the metallic housing and slide slots 232 on opposite sides of the metallic housing 2. The metallic housing elements corresponds to the insulating housing elements, such that the fold structure piece 201, the inward projected stop wedges 231 and the slide slots 231, all components of the metallic housing, are mated with slots 111 located on the insulating housing, notches 131 on opposite sides on the insulating housing and the protrusions 132 located on the insulating housing respectively. Furthermore, the fold plate 202 is designed to accommodate the whole insulated housing 1 inside the metallic housing 2, wherein a plurality of clamps 241 furnished on the top and bottom surfaces of the metallic housing 2 are designed to latch onto the plug connector accordingly.

From the aforementioned description, it is understood that the metallic housing 2 and the insulated housing 1 are fabricated and assembled through a multiple locking mechanism to form a rigid and compact structure consistent with the strict design requirements of HDMI devices. In addition to the fold structure piece 201, the fold plate 202, the inward projected stop wedges 231 and the slide slots 232 of the metallic housing other features include solder pins 21 and a flange 22 furnished with a lock hole, which folds in a vertical upward direction and fulfill the requirements of both the printed circuit board and the housing structure.

Figure 3:
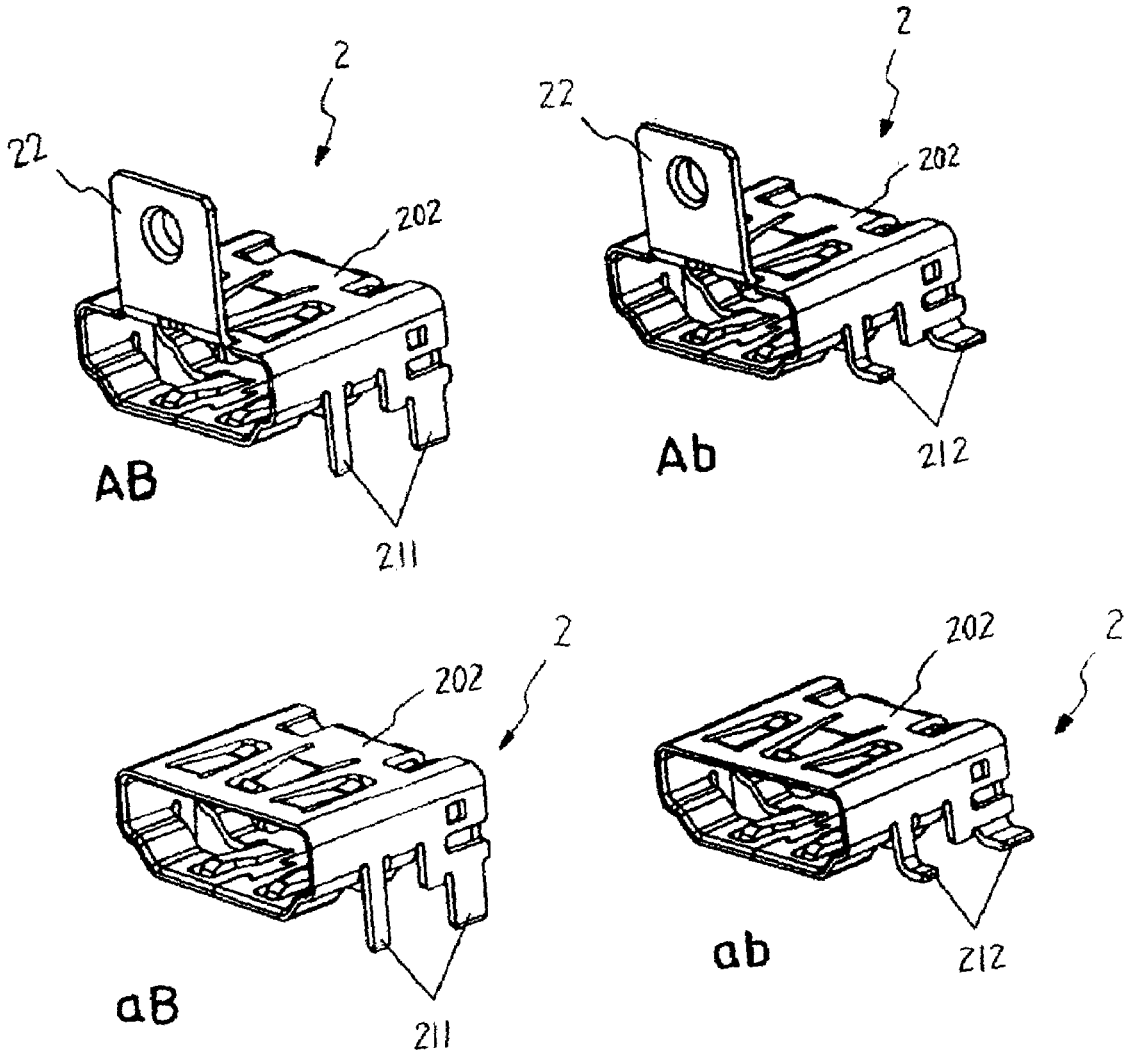
FIG. 3 is a perspective view of the HDMI connector's metallic housing embodiments illustrating four types of metallic housing.

FIG. 3 illustrates four types of metallic housing embodiments: an "AB" type metallic housing with a flange 22 and with vertical insertion type solder pins 211 on opposite ends of the metallic housing; an "Ab" type metallic housing with a flange 22 and with horizontal SMT type solder pins 212 on opposite sides of the metallic housing; an "aB" type metallic housing without a flange 22 and with vertical insertion type solder pins 211 on opposite sides of the metallic housing; and an "ab" type metallic housing with a flange 22 and with horizontal SMT type solder pins 212 on opposite sides of the metallic housing.

Figure 4:
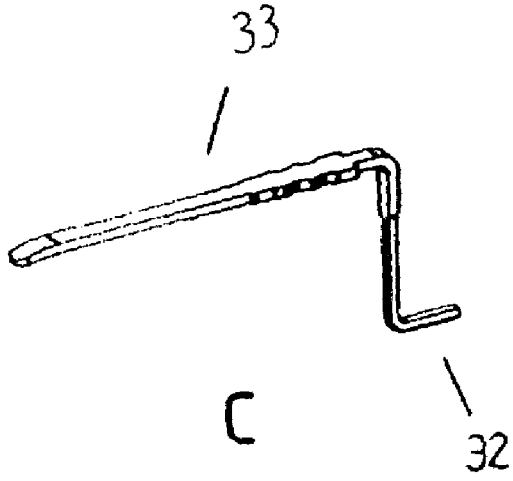
FIG. 4 illustrates two types of contact terminal unit elements, wherein a first type is comprised of spikes whose rear ends are bent and flattened to form horizontal SMT type terminal solder pins, and a second type is comprised of spikes whose rear end are not bent and not flattened to form vertical insertion type pins.
Figure 4:
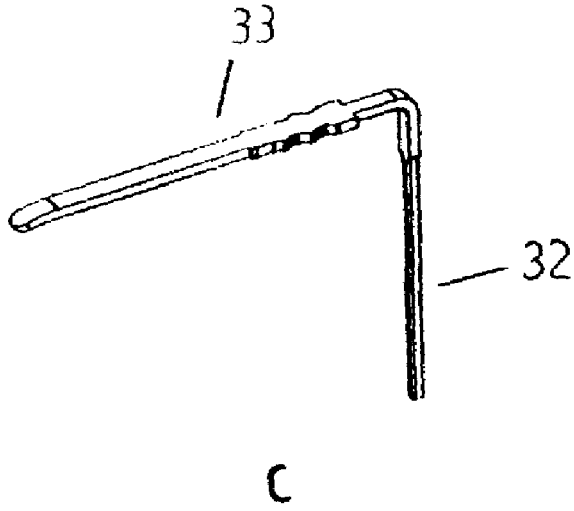

Referring to FIG. 1 and FIG. 2 and the front end terminal contact portion of the contact terminal unit 3, there are disclosed spikes 33 whose front ends are used for fixing the contact terminal within the insulating housing when inserted and whose rear ends are folded to form solder pins. FIG. 4 illustrates the two types of contact terminal unit elements of the present invention. A first type designated by "C" is a contact terminal unit with spikes 33 whose rear ends are bent and flattened to form horizontal SMT type terminal solder pins 32. A second type designated by "c" is a contact terminal unit with spikes 33 whose rear end are not bent and not flattened to form vertical insertion type pins 32.

The assembling process of the present HDMI invention begins with placing the terminals of the contact unit 3 into the guide slots 103 of the terminal block 102 of the insulated housing and placing the terminal solder pin into the positioning path 121 on the bottom surface of the main body 10. The front surface 101 of the insulated housing 1 will thrust against the rear end of the bottom insertion slot of the metallic housing 2 when interlocked with each other. The notches 131 of the side surfaces 13 of the insulated housing are mated with the corresponding inward projected stop plates 231 of the metallic housing, thereby thrusting the stop block 1311 against the inward projected stop plates 231, and thus securing the insulated housing in the metallic housing without backward displacement. The projections 132 of the side surfaces 13 mates with the side slots 232 to secure the insulated housing in the metallic housing without forward displacement. In addition the fold piece 201 on the top surface 20 of the metallic housing is folded to mate with the slot 111 on the top surface 11 of the insulated housing to reinforce the interlocking of the insulated and metallic housings, and the fold plate 202 of the metallic housing 2 is folded to accommodate the insulated housing 1 into the metallic housing 2.

FIG. 5 through FIG. 12 illustrate the various preferred embodiments and module combination modules of the present invention. Referring to FIG. 5, which is the first embodiment of this invention, there is disclosed a combination module designated as "ABC" type connector with vertical insertion type solder pins 211, with horizontal SMT type terminal solder pins 32 and with a flange 22 attached to the metallic housing 2. Referring to FIG. 6, which is the second embodiment of this invention, there is disclosed a combination module designated as "ABc" type with vertical insertion type solder pins 211, with vertical insertion type solder terminal pins 31 and with a flange 22 attached to the metallic housing 2. Referring to FIG. 7, which is the third embodiment of this invention, there is disclosed a combination module designated as "AbC" type with horizontal SMT type solder pins 212, with horizontal SMT type terminal solder pins 32 and with a flange 22 attached to the metallic housing 2. Referring to FIG. 8, which is the fourth embodiment of this invention, there is disclosed a combination module designated as "Abc" type with horizontal SMT type solder pins 212, with vertical insertion type terminal solder pins 32 and with a flange 22 attached to the metallic housing 2. FIG. 5 through FIG. 8 constitute the first four embodiments of this invention.

Figure 12:
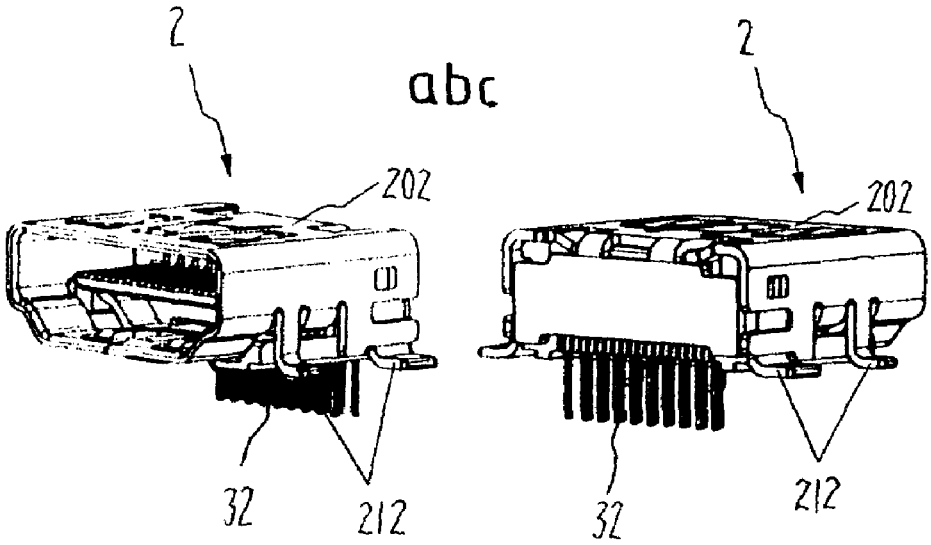
FIG. 12 is a perspective view of the eight embodiment of the present invention illustrating a combination module designated as "abc" type connector.

FIG. 9 through FIG. 12 constitute the second four embodiments of this invention. Referring to FIG. 9, which is the fifth embodiment of this invention, there is disclosed a combination module designated as "aBC" type with vertical insertion type solder pins 211, with horizontal SMT type terminal solder pins 32 and without a flange 22 attached to the metallic housing 2. Referring to FIG. 10, which is the sixth embodiment of this invention, there is disclosed a combination module designated as "aBc" type with vertical insertion type solder pins 211, with vertical insertion type terminal solder pins 32 and without a flange 22 attached to the metallic housing 2. Referring to FIG. 11, which is the seventh embodiment of this invention, there is disclosed a combination module designated as "abC" type with horizontal SMT type solder pins 212, with horizontal SMT type terminal solder pins 32 and without a flange 22 attached to the metallic housing 2. Referring to FIG. 12, which is the eighth embodiment of this invention, there is disclosed a combination module designated as "abc" type with horizontal SMT type solder pins 212, with vertical insertion type terminal solder pins 32 and without a flange 22 attached to the metallic housing 2.

The present invention is comprised of four metallic housing modules, a single insulated housing module and two contact terminal units modules, which enhance flexibility and swiftness during the assembling process, reduce the need to stockpile materials and promote mobility of the product variation along the assembly line due the presence of interchangeable components.

Although the present invention has been described with reference to a preferred embodiment thereof, it is apparent to those skilled in the art that there are a variety of modifications and changes that may be made without departing from the scope of the present invention, which is intended to be defined by the appended claims.

What is claimed is:

1. A HDMI connector comprising: a contact terminal unit composed of vertical insertion types and horizontal SMT types; an insulated housing, composed of a rectangular main body, a flat terminal block projected from the front surface of said main body, a plurality of guide slots furnished on the top and bottom sides of said terminal block for inserting a terminal portion of said contact terminal unit, wherein said guide slots are fed through a hollow portion of a rear end portion of said main body; a metallic housing adapted for engaging said insulated housing; a flange; and a solder pin composed of vertical insertion types and horizontal SMT types.

2. The HMDI connector according to claim 1, further comprising dented slots furnished on both sides of said main body's top surface, and said dented slots are used to latch with resilient fold pieces on said metallic housing.

3. The HDMI connector according to claim 1, further comprising slots and projections furnished on both side surfaces of said main body, said slots are mated with inward projected stop wedges of said metallic housing, and stop blocks on each side surface of said main body furnished at inner ends of said slots, wherein said stop blocks are made to thrust against stop wedges to secure said insulated housing inside said metallic housing without further backward displacement.

4. The HDMI connector according to claim 1, wherein positioning paths at rear portions of the main body's bottom surface provide an equal number of guide slots for inserting terminals of said terminal contact unit.

5. The HDMI connector according to claim 1, wherein a bottom plate extends from front ends of said main body's bottom surface and inclined end sections of both side walls of said main body form a carrier used for integrating with said bottom surface of said metallic housing and thereby firmly fixing said insulating housing within said metallic housing.

6. The HDMI connector according to claim 1, wherein a recess furnished on the bottom plate is positioned and aligns with a clamp on the bottom surface of said metallic housing, wherein said clamp remains available after integrating said metallic housing with said insulated housing, and positioning posts are provided at the bottom of said insulated housing to secure and position the connector firmly on a printed circuit board.

7. The HDMI connector according to claim 1, wherein a perfectly formed insertion opening located at said metallic housing's front end is furnished on both sides.

8. The HDMI connector according to claim 7, wherein said insulated housing's integration structure and said metallic housing's rear portion further comprises a fold piece located on the top surface of said connector, a fold plate extended to the rear end of said connector, an inward projected stop wedge and a slide slot.

9. The HDMI connector according to claim 8, wherein said fold piece is mated with said insulated housing's slot.

10. The HDMI connector according to claim 8, wherein said inward projected stop wedge is mated with a notch.

11. The HDMI connector according to claim 8, wherein said slide slot is mated with a protrusion.

12. The HDMI connector according to claim 8, wherein said fold plate is foldable to accommodate the entire insulated housing inside the metallic housing when the insulated housing is inserted therein.

13. The HDMI connector according to claim 1, wherein said flange is furnished with lock hole.

14. The HDMI connector according to claim 1, wherein said metallic housing utilizes said flange and said solder pin having a vertical, insertion type structure.

15. The HDMI connector according to claim 1, wherein said metallic housing utilizes said flange and said solder pin having a horizontal, SMT type structure.

16. The HDMI connector according to claim 1, wherein said metallic housing is without said flange and utilizes said solder pin having a vertical, insertion type structure.

17. The HDMI connector according to claim 1, wherein said metallic housing is without said flange and utilizes said solder pin having a horizontal, SMT type structure.

18. The HDMI connector according to claim 1, wherein said contact terminal unit utilizes said solder pin having a horizontal, SMT type structure.

19. The HDMI connector according to claim 1, wherein said contact terminal unit utilizes said solder pin having a vertical, insertion type structure.

* * * * *